US011725333B2

(12) United States Patent
Kang et al.

(10) Patent No.: US 11,725,333 B2
(45) Date of Patent: Aug. 15, 2023

(54) MULTI-FUNCTIONAL STORAGE SYSTEM FOR PREVENTING WATER FROM CONDENSING ON INNER SIDE OF DOOR AND METHOD FOR DRYING INNER SIDE OF DOOR USING SAME

(71) Applicant: COWAY CO., LTD., Gongju-si (KR)

(72) Inventors: Tae Kyung Kang, Seoul (KR); In Kyu Back, Seoul (KR); Hyo Sung Kim, Seoul (KR); Kyung Su Lee, Seoul (KR); Gyeongcheol Sin, Seoul (KR); Il Song Park, Seoul (KR); Dong Hun Lee, Seoul (KR); Jin Min Kim, Seoul (KR); Sung Hwan Heo, Seoul (KR); Hyun Kuk Choi, Seoul (KR); Byung Soo Yun, Seoul (KR)

(73) Assignee: COWAY CO., LTD., Gongju-si (KR)

( * ) Notice: Subject to any disclaimer, the term of this patent is extended or adjusted under 35 U.S.C. 154(b) by 303 days.

(21) Appl. No.: 17/257,430

(22) PCT Filed: Jun. 21, 2019

(86) PCT No.: PCT/KR2019/007495
§ 371 (c)(1),
(2) Date: Dec. 31, 2020

(87) PCT Pub. No.: WO2020/009355
PCT Pub. Date: Jan. 9, 2020

(65) Prior Publication Data

US 2021/0222350 A1 Jul. 22, 2021

(30) Foreign Application Priority Data

Jul. 3, 2018 (KR) ..... 10-2018-0077268
Jul. 3, 2018 (KR) ..... 10-2018-0077269

(51) Int. Cl.
*D06F 58/10* (2006.01)
*D06F 73/02* (2006.01)
(Continued)

(52) U.S. Cl.
CPC ..... *D06F 58/10* (2013.01); *D06F 58/20* (2013.01); *D06F 73/02* (2013.01); *D06F 58/203* (2013.01); *D06F 58/22* (2013.01)

(58) Field of Classification Search
CPC ..... D06F 73/02; D06F 58/10; D06F 58/20; D06F 58/203; D06F 58/22
See application file for complete search history.

(56) References Cited

U.S. PATENT DOCUMENTS 3,049,903 A * 8/1962 Sussman ..... D06F 73/02 68/12.26
4,682,424 A * 7/1987 Irving ..... A47G 25/485 312/273
(Continued)

FOREIGN PATENT DOCUMENTS

JP 8-257294 A 10/1996
JP 8-276098 A 10/1996
(Continued)

OTHER PUBLICATIONS

Combined Chinese Office Action and Search Report dated Jul. 5, 2022 in Chinese Patent Application No. 201980045018.4 (with English translation of category of cited documents), 9 pages
(Continued)

*Primary Examiner* — Benjamin L Osterhout
(74) *Attorney, Agent, or Firm* — Oblon, McClelland, Maier & Neustadt, L.L.P.

(57) ABSTRACT

A multi-functional storage system includes a storage compartment and a machine compartment provided at one side of the storage compartment. The multi-functional storage
(Continued)

system also includes a door provided at a foreside of the storage compartment and the machine compartment. The machine compartment includes an intake port and an exhaust port communicating with outside air, and a blower unit for drawing in the outside air through the intake port and exhausting it through the exhaust port. While the door is closed and the intake port and the exhaust port are open, the blower unit is operated so as to dry an inner side of the door.

14 Claims, 15 Drawing Sheets

(51) Int. Cl.
*D06F 58/20* (2006.01)
*D06F 58/22* (2006.01)

(56) References Cited

U.S. PATENT DOCUMENTS 6,868,621 B1* 3/2005 Grimm ..... D06F 34/26 34/511
8,296,967 B2 10/2012 Kim et al.
9,074,313 B2 7/2015 Kim et al.
2002/0133969 A1* 9/2002 Cassella ..... D06F 58/10 34/201
2005/0016016 A1* 1/2005 Lickiss ..... D06F 58/04 34/601
2006/0137208 A1* 6/2006 Lee ..... D06F 73/02 34/201
2010/0018072 A1* 1/2010 Kim ..... D06F 58/203 62/238.7
2010/0132208 A1* 6/2010 Moon ..... D06F 58/10 34/202
2010/0146805 A1 6/2010 Kim et al.
2011/0296703 A1 12/2011 Kim et al.
2015/0113825 A1* 4/2015 Goulet ..... F26B 9/06 34/443
2019/0263586 A1* 8/2019 Nam ..... A47B 61/00

FOREIGN PATENT DOCUMENTS

JP 2002-136799 A 5/2002
JP 2002-272570 A 9/2002
JP 2009-183388 A 8/2009
JP 2011-152186 A 8/2011
KR 10-2007-0110653 A 11/2007
KR 10-2010-0066176 A 6/2010
KR 10-2010-0121201 A 11/2010
KR 10-2010-0125508 A 12/2010
KR 10-2011-0082375 A 7/2011
KR 10-2018-0052960 A 5/2018

OTHER PUBLICATIONS

International Search Report dated Oct. 28, 2019 in PCT/KR2019/007495 filed on Jun. 21, 2019, citing references AA-AD and AO-AS therein, 2 pages.
Notice of Allowance dated Dec. 8, 2021 in Korean Patent Application No. 10-2018-0077269, citing documents AO through AQ therein, 6 pages.

* cited by examiner

MULTI-FUNCTIONAL STORAGE SYSTEM FOR PREVENTING WATER FROM CONDENSING ON INNER SIDE OF DOOR AND METHOD FOR DRYING INNER SIDE OF DOOR USING SAME

TECHNICAL FIELD

The present invention relates to a multi-functional storage system for preventing water from condensing on an inner side of a door and a method for drying the inner side of the door using the same, and more particularly, to a multi-functional storage system for drying the inner side of the door to prevent a phenomenon in which water droplets are formed on a bottom of the multi-functional storage system and fall onto floor, and a drying method using the same.

BACKGROUND ART

In a wardrobe, storage closet, or clothes care system, which are kinds of cabinets that store articles such as clothes, blankets, various household articles, and the like therein, steam is used to remove contaminants such as dust, odorous substances, or the like that may be attached to the articles while the articles are directly used by the user and also to improve wrinkles.

The principle is that as steam is directly sprayed on the articles such as clothes or the like inside the cabinet, the water molecules of the steam surround contaminants or odorous substances and evaporate together, thereby removing the contaminants or odorous substances and also improving wrinkles.

As used herein, "steam" refers to high-temperature water of about 100 degrees Celsius that is sprayed in gaseous form through a high-pressure nozzle, and the like, and becomes visible as whitish smoke upon being sprayed at room temperature.

However, damage in clothes or the like has been reported during use of steam, which is a problem. For example, when high-temperature steam or high-temperature/high-pressure steam is directly sprayed onto clothes made of delicate materials, it may damage the material. As another example, when water molecules generated by steam are sprayed at room temperature, they then condense into water droplets, and unless dehumidification is performed effectively, the water droplets remain on the clothes as they are, and when this condition persists for a long period of time, it may also damage the clothes made of delicate materials.

In addition, when steam is directly sprayed on plastic parts or the like included in clothes or the like, a fatal problem may occur in which environmental hormones that are very harmful to the human body are generated, and accordingly, there is a need for a technology capable of cleaning clothes or the like stored in a storage compartment without using high-temperature steam.

Meanwhile, closets, storage cabinets, or clothes care systems, as kinds of cabinets, can operate in a clothes care mode with the door closed, during which the air circulating through the space storing the clothes is relatively high-temperature and high-humidity air compared to outside air. At this time, as the air is circulated inside the door with the door being closed, the water vapor condenses or water droplets form on the inner side of the door, resulting in a problem of water falling onto the bottom surface. The phenomenon of falling water also occurs even when high-temperature and high-humidity air leaks out. This problem causes inconvenience in that the user has to periodically remove the water falling on the floor, and when the user does not remove the falling water, there may occur a fatal problem to the cleanliness of the space, such as the propagation of bacteria or the like. Accordingly, in recent years, there has been a very high demand for a technology capable of preventing condensation of water droplets on the inner side of the door of a system such as a clothes care system.

(Patent Literature 1) Korean Laid-open Patent Application No. 10-2007-0110653

DISCLOSURE

Technical Problem

The present invention has been devised to solve the problems described above.

Specifically, a drying method capable of drying water droplets on an inner side of a door of a multi-functional storage system and a structure of a multi-functional storage system performing the same are proposed.

In addition, a method and structure are proposed for drying an inner side surface of the door without heating the door itself, by using various components of the multi-functional storage system.

In the process of performing the clothes care mode, a structure is proposed of a multi-functional storage system for removing water droplets generated by high-temperature and high-humidity air that partly leaks from the inner side surface of the door.

Technical Solution

In an embodiment of the present invention for solving the problems described above, a multi-functional storage system is provided, in which the multi-functional storage system may include a storage compartment 100 and a machine compartment 200 provided at one side of the storage compartment 100, and include: a door 600 provided at a foreside of the storage compartment 100 and the machine compartment 200, in which the machine compartment 200 may include: an intake port 210 and an exhaust port 250 communicating with outside air; and a blower unit 230 for drawing in the outside air through the intake port 210 and exhausting it through the exhaust port 250, in which, while the door 600 is closed and the intake port 210 and the exhaust port 250 are open, the blower unit 230 may be operated so as to dry an inner side of the door 600.

In addition, the multi-functional storage system may further include a circulation air inlet 141 and a circulation air outlet 142 communicating the storage compartment 100 with the machine compartment 200, in which, in a door drying mode for drying the inner side of the door 600, the blower unit 230 may be operated while the circulation air inlet 141 and the circulation air outlet 142 are closed.

In addition, a recirculation module 300 including a recirculation blower may be provided at an upper end of the storage compartment 100, and the recirculation module 300 may discharge air downward in the storage compartment 100, and in a storage compartment drying mode of drying the storage compartment 100, the recirculation blower may be operated while the circulation air inlet 141 and the circulation air outlet 142 are closed, and the door drying mode and the storage compartment drying mode may be operated simultaneously.

In addition, the machine compartment 200 may further include a clean filter unit 219 for filtering the outside air drawn in from the intake port 210, in which the door 600 may include an exhaust door 650 formed on one side, and may be formed to cover the foreside of the machine compartment 200 and the storage compartment 100 except for the intake port 210, and in an air cleaning mode of filtering the outside air, the circulation air inlet 141 and the circulation air outlet 142 may be closed, and the intake port 210, the exhaust port 250, and the exhaust door 650 may be open, and in the door drying mode and the storage compartment drying mode, the exhaust door 650 may be closed.

In addition, the exhaust door 650 may be formed at a position to face the exhaust port 250 of the machine compartment 200 when the door 600 is closed.

The present invention provides a method of drying an inner side of a door using the multi-functional storage system described above, in which the method may include steps of: (a) while the door 600 is closed, opening both the exhaust port 250 and the intake port 210 facing the inner surface of the door 600 (S100); and (b) operating the blower unit 230 provided in the machine compartment 200 such that the outside air is drawn in through the intake port 210 and then discharged through the exhaust port 250, drying the inner side of the door 600 with the air discharged through the exhaust port 250 (S110).

In one embodiment, the door 600 may include an exhaust door 650 formed on one side, and may be formed to cover the foreside of the machine compartment 200 and the storage compartment 100 except for the intake port 210, and the step (a) may further include a step of (a1) closing the exhaust door 650 when the exhaust door 650 is open (S102).

In addition, the step (a) may further include a step of (a2) blocking communication between the storage compartment 100 and the machine compartment 200 (S104).

In addition, a recirculation module 300 including a recirculation blower may be provided at an upper end of the storage compartment 100, and the recirculation module 300 may discharge air downward in the storage compartment 100, and in the step (b), the recirculation blower may be simultaneously operated as the blower unit 230 is operated.

In addition, according to another embodiment, a multi-functional storage system is provided, which may include: a dehumidification unit 260 that dehumidifies circulation air flowing in the storage compartment 100; a circulation air inlet 141 and a circulation air outlet 142 communicating the storage compartment 100 with the machine compartment 200; a circulation filter unit 229 that supplies moisture to the circulation air supplied to the storage compartment 100 through the circulation air inlet 141; and a dehumidification blower 290 provided on a side of the exhaust port 250, in which the dehumidification blower 290 dries circulation air exiting through the exhaust port 250.

In one embodiment, the dehumidification blower 290 may be provided at an end side of the exhaust port 250 based on a direction of air discharged from the exhaust port 250.

In addition, the dehumidification blower 290 may be provided at both end sides of the exhaust port 250, and formed to blow in a direction of both end sides facing each other.

In addition, the dehumidification blower 290 may be provided on a side end inside the exhaust port 250, and formed to blow in a direction perpendicular to the direction of the air discharged from the exhaust port 250.

In addition, while the circulation air inlet 141 and the circulation air outlet 142 are open and the exhaust port 250 is closed, the dehumidification blower 290 may be operated as natural humidified air generated by the circulation filter unit 229 is supplied to and circulated in the storage compartment 100 by the blower unit 230.

In addition, the machine compartment 200 may further include: a first flow path 220 in communication with the blower unit 230; a second flow path 240 in communication with each of the exhaust port 250, the blower unit 230, the first flow path 220, and the storage compartment 100; a first flow path switching member 241 that opens and closes the circulation air inlet 141; and a second flow path switching member 242 that opens and closes the circulation air outlet 142, in which the first and second flow path switching members 241 and 242 may selectively communicate the second flow path 240 with the exhaust port 250 or with the storage compartment 100, and the dehumidification blower 290 may be operated while the second flow path 240 and the storage compartment 100 are in communication with each other.

Advantageous Effects

According to the present invention, a blower unit is operated while a door is closed to dry an inner side of the door, thereby providing an effect of removing water droplets formed on the inner side of the door without requiring a separate action by a user. In addition, since the door is provided with a separate exhaust door, when switching from a door drying mode to an air cleaning mode or vice versa, it is possible to switch the modes with minimal component operation. By adopting a method of supplying dry air to the inner side of the door, instead of the method of heating the door itself, the effect of minimizing power consumption is provided.

In addition, according to the present invention, a separate dehumidification blower is provided in the exhaust port, and the air blown by the dehumidification blower is formed in a direction perpendicular to the discharge direction of the exhaust port, so that an air curtain can be formed in the exhaust port, thereby limiting the loss of high-temperature and high-humidity circulation air to the outside in the clothes care mode. When performing the clothes care mode, even when the high-temperature and high-humidity circulation air leaks out to the outside, dry air can be blown through the dehumidification blower to dry the same, thereby preventing a phenomenon in which high-temperature and high-humidity air stay in the space between the door and the machine compartment.

Accordingly, it is possible to prevent the occurrence of water droplets condensing on the inner side of the door, on the outer surface of the machine compartment, and around the gasket, thus improving the cleanliness of the space where the multi-functional storage system is installed, and eliminating inconvenience that occurs as the user has to remove water droplets falling on the floor, and thereby providing an effect of increased user convenience.

DETAILED DESCRIPTION OF THE INVENTION

Figure 1:
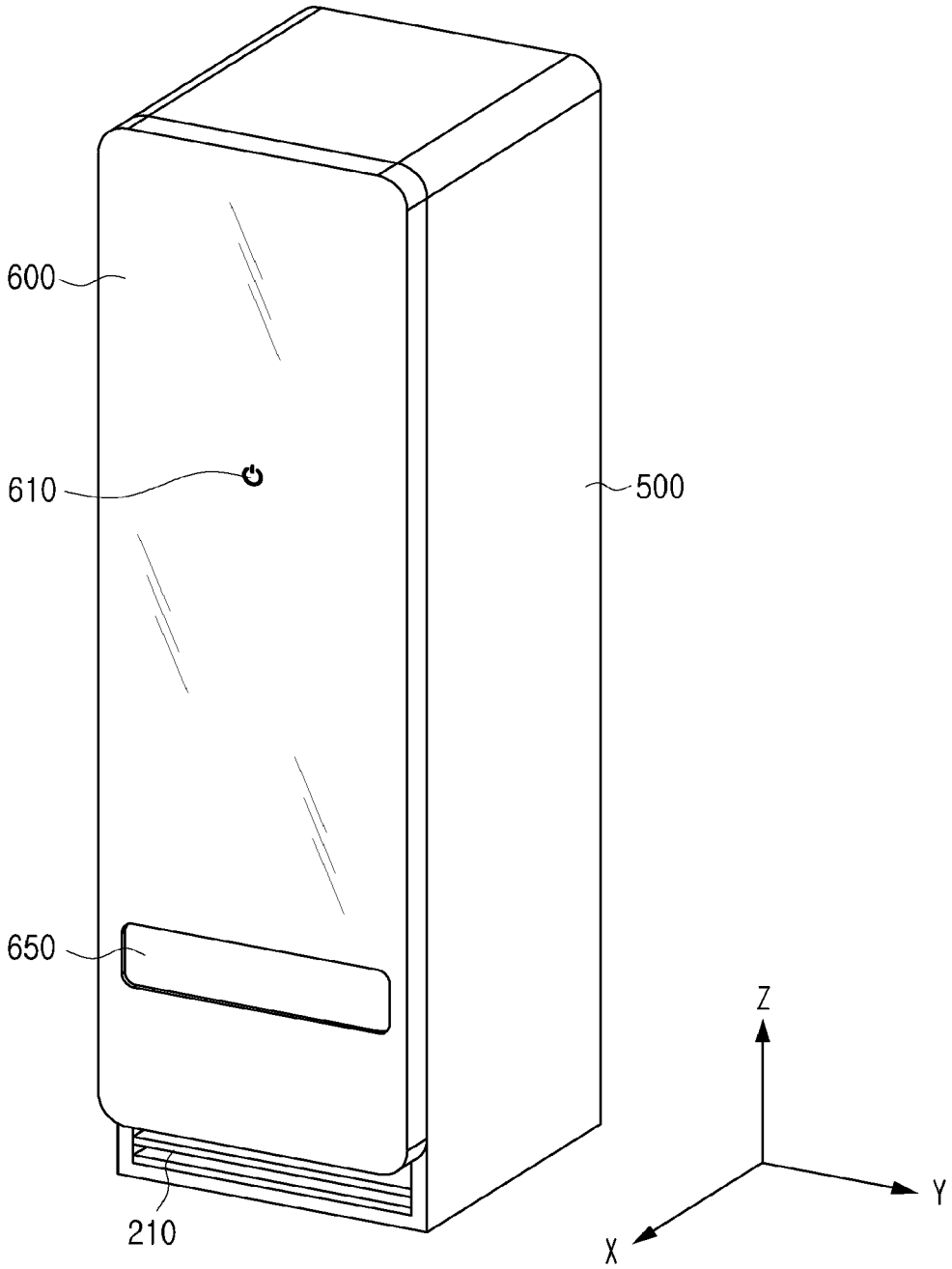
FIG. 1 is a perspective view showing an appearance of a multi-functional storage system according to the present invention.

Hereinafter, a multi-functional storage system according to the present invention will be described with reference to the drawings.

For explanation, terms such as front (X axis), back (−X axis), right (Y axis), left (−Y axis), upward (Z axis), and downward (−Z axis) are used, and the coordinate system is shown in the drawings, but these are merely for illustration, and the present invention is not limited to such directions.

Description of Structure of Multi-Functional Storage System

A multi-functional storage system according to the present invention will be described with reference to FIGS. 1 to 4.

The multi-functional storage system according to the present invention includes a storage compartment 100, a machine compartment 200, a recirculation module 300, a casing 500, and a door 600.

Figure 2A:
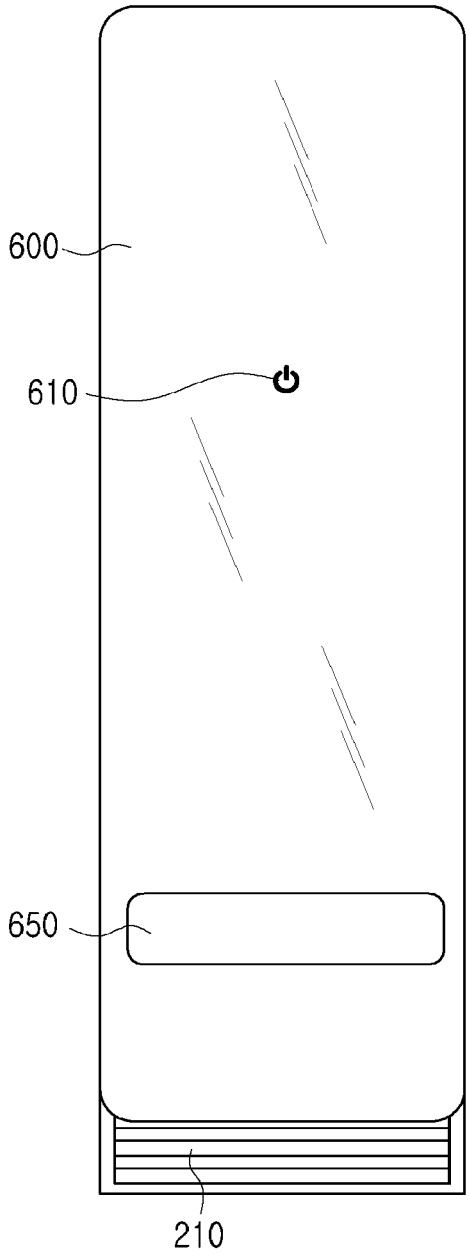
FIG. 2A is a front view showing the multi-functional storage system with a door closed according to the present invention.
Figure 2B:
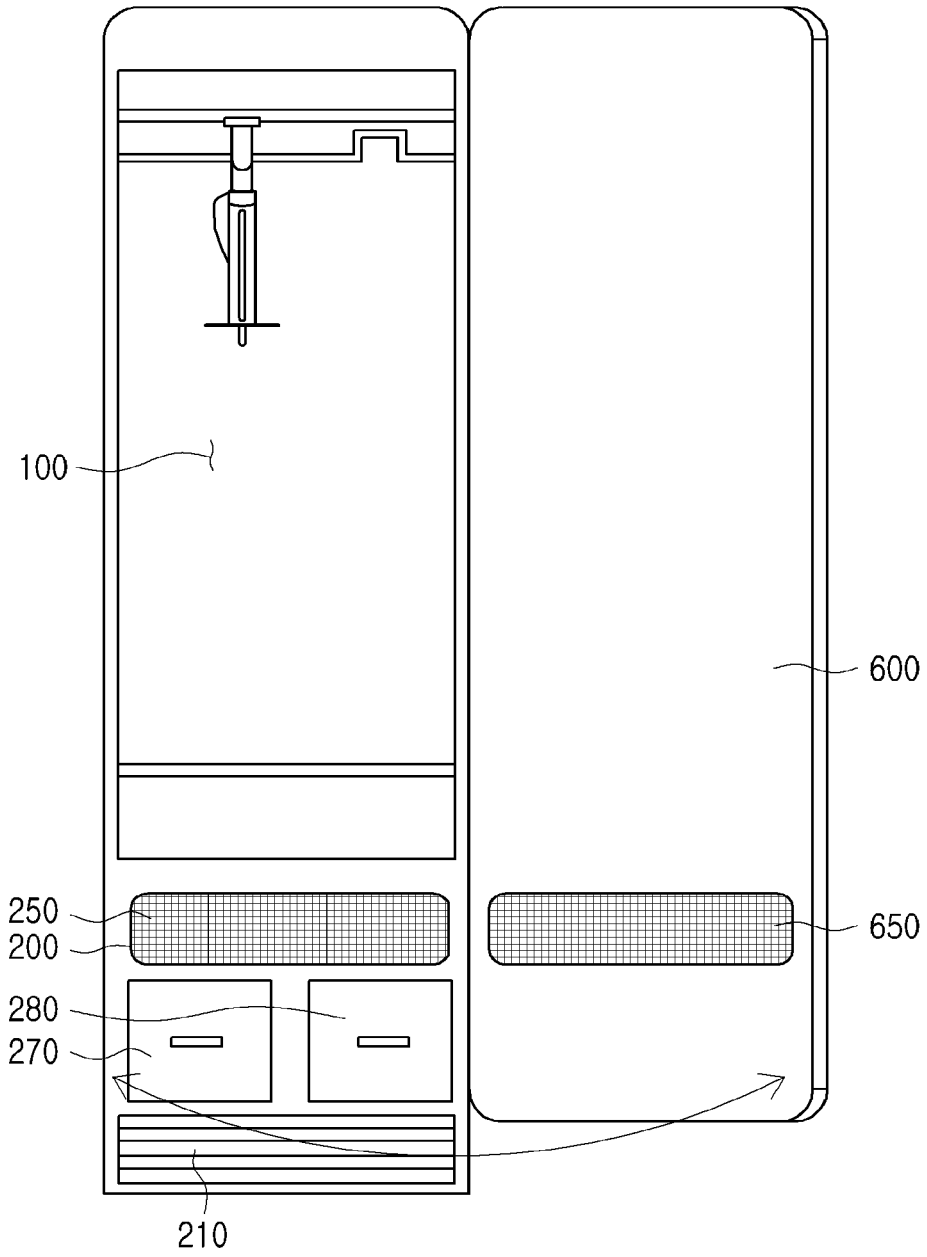
FIG. 2B is a front view showing the multi-functional storage system with the door open according to the present invention.
Figure 3:
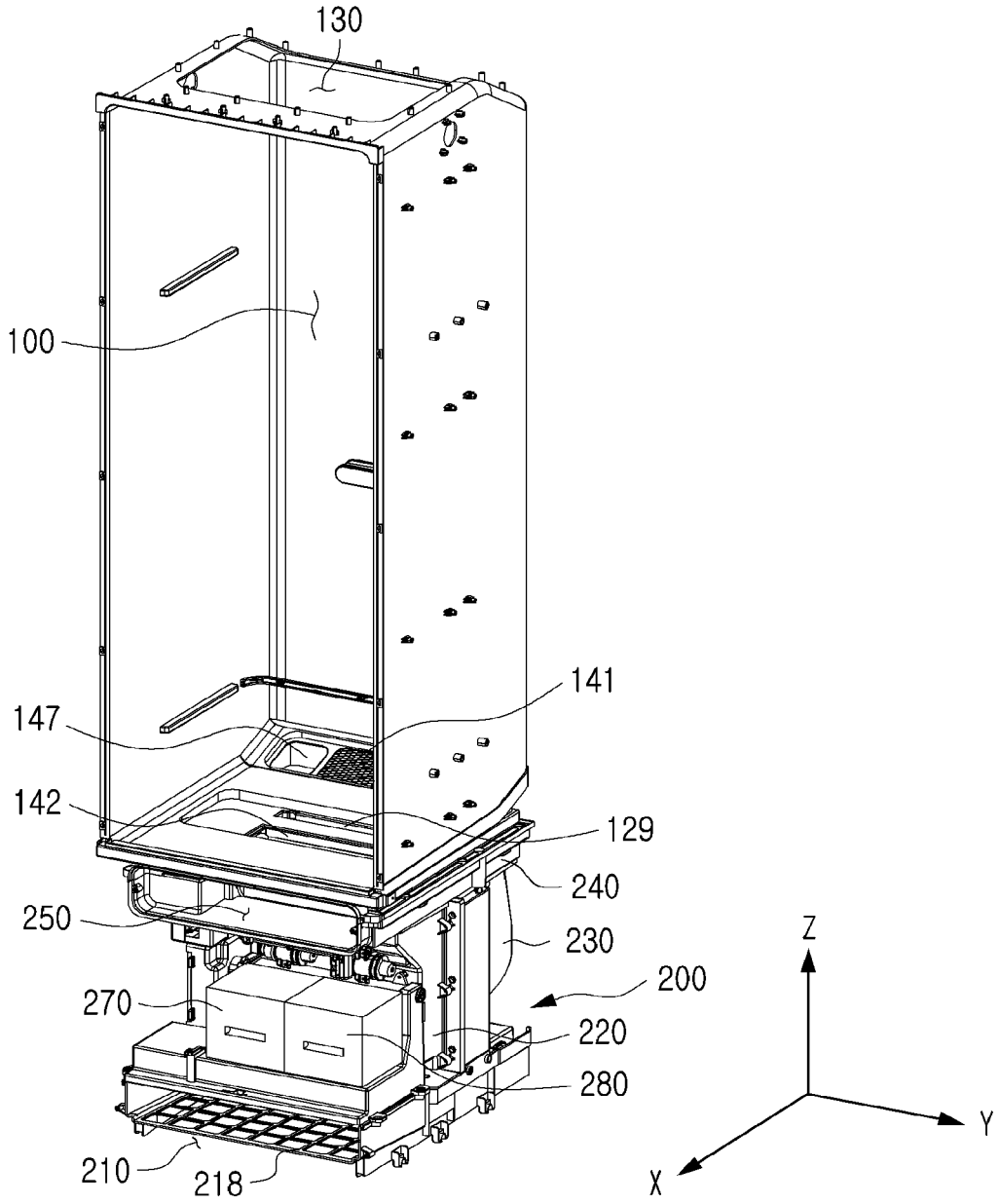
FIG. 3 is a perspective view showing an interior of the multi-functional storage system according to the present invention, from which the illustrations of a casing, the door, and a recirculation module are removed for the sake of explanation.
Figure 4:
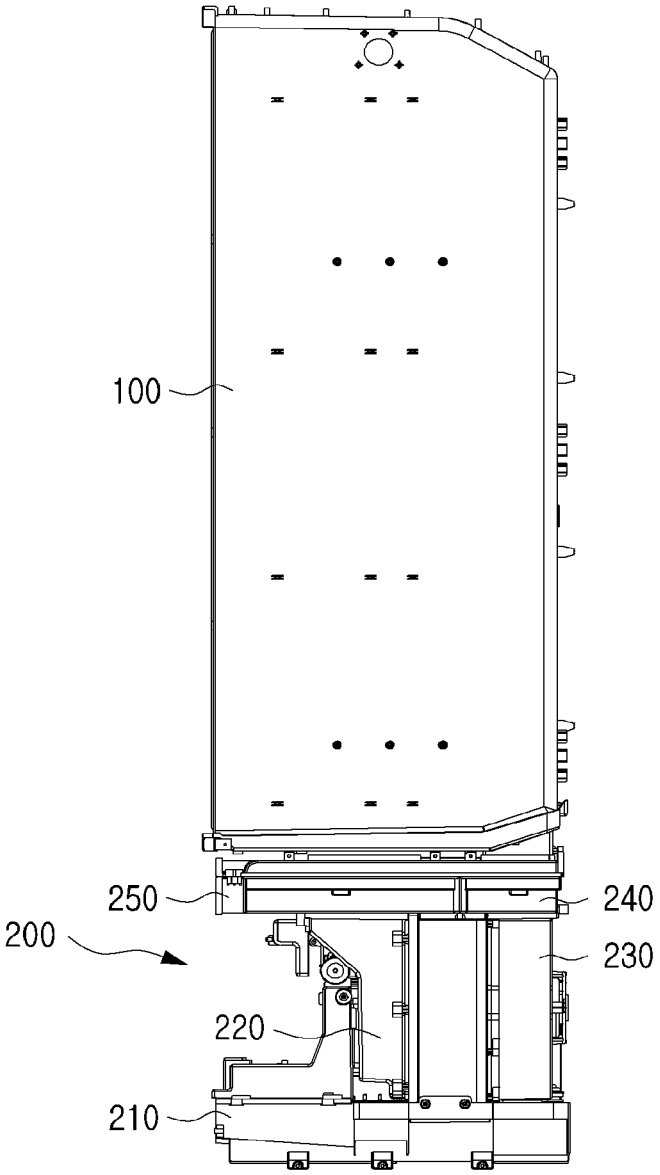
FIG. 4 shows a right side view of the interior of the multi-functional storage system according to the present invention.

With reference to FIGS. 1, 2A, and 2B, the casing 500 forms the appearance of the multi-functional storage system.

First, the door 600 forms a foreside of the multi-functional storage system, and a user can open the door 600 to access the interior of the storage compartment 100. When the user opens the door 600, in the storage compartment 100 portion, the interior of the storage compartment 100 is revealed, and in the machine compartment 200 portion, an exhaust port 250, a supply water tank 270, and a condensate water tank 280 are revealed. Meanwhile, the door 600 does not cover an intake port 210. This is because the lowermost end of the door 600 is positioned above the intake port 210. This is to perform air cleaning even without opening the door 600 in the air cleaning mode.

A control unit 610 and an exhaust door 650 are positioned on an outer surface of the door 600. The control unit 610 includes an input unit through which the user can select the operation mode, and an output unit that can output a current operation state. The exhaust door 650 is communicated with the exhaust port 250 of the machine compartment 200 such that in the air cleaning mode, opening the exhaust door 650 alone may cause the filtered outside air to be discharged out without requiring the door 600 to be open.

It is preferable that the door 600 be formed of a half-mirror. This is to provide convenience to the user, by directly showing the user the clothes or the like positioned inside the storage compartment 100 when necessary, and depending on situations, by also performing a mirror function for the user who has taken out clothes or the like from the storage compartment 100.

FIG. 2B is a front view showing the multi-functional storage system with the door open according to the present invention. Referring to FIG. 2B, the exhaust door 650 is formed at a position to face the exhaust port 250 of the machine compartment 200 when the door 600 is closed. In addition, a grill part may be provided on the foreside of the exhaust port 250 to prevent ingress of foreign substances and also prevent physical injury to the user due to the user's carelessness, and another grill part may be provided on the backside of the exhaust door 650. Meanwhile, a dehumidification blower 290 is provided in the exhaust port 250 of the multi-functional storage system according to the present invention, which will be described in detail below.

The storage compartment 100 is a space in which clothes or the like are stored and rid of contaminants or malodorous substances. To this end, the temperature inside the storage compartment 100 may be increased to a high temperature, and then natural humidified air may be flowed thereinto as the circulation air and circulated. Details will be described below in connection with the operation mode.

When the storage compartment 100 is viewed from the inside, a circulation filter detaching part 129, a circulation air inlet 141, a circulation air outlet 142, and a functional material receiving part 147 are positioned on a lower surface.

The circulation filter detaching part 129 is an opening provided to allow easy detachment of a circulation filter unit 229 positioned in the machine compartment 200 for repair or replacement. The circulation air inlet 141 and the circulation air outlet 142 are openings through which circulation air inside the storage compartment 100 flows in and out of the machine compartment 200, respectively.

The circulation air inlet 141 is formed in communication with a blower unit 230 such that air is discharged from the machine compartment 200 toward the storage compartment 100, and the circulation air outlet 142 is formed such that the air is circulated from the storage compartment 100 toward the machine compartment 200.

In addition, a portion in communication with the circulation air inlet 141 in the storage compartment 100 is formed to be inclined upward, so that the air introduced from the circulation air inlet 141 is discharged at a predetermined angle upwardly from an inner bottom surface of the storage compartment 100 to the inner space of the storage compartment 100. Accordingly, the circulation air discharged from the circulation air inlet 141 is in contact with a wider area of the clothes or the like stored in the storage compartment 100 than when it is discharged in a vertical direction, thereby increasing cleaning efficiency.

In addition to the function of removing contaminants or malodorous substances from the articles such as clothes or the like stored in the storage compartment 100, a material for providing another function may be stored in the space of the functional material receiving part 147, and for example, aroma substances or the like may be accommodated and discharged to the storage compartment 100. In addition, the functional material may be formed to be periodically filled by a user.

A recirculation module mounting part 130 on which the recirculation module 300 is mounted is positioned at an upper inner side of the storage compartment 100. The recirculation module 300 may include an air shot hanger (see FIG. 2B) having an air shot function.

Optionally, a hanger (see FIG. 2B) may be positioned at a center of the upper inner side of the storage compartment 100, and a pants hanger (not shown) or the like may be further positioned on left and right inner wall surfaces.

The machine compartment 200 is not only a space for performing the air cleaning mode, but also the space for performing the air clothes care mode during which it operates to circulate air by introducing the air from the storage compartment 100, filtering the same, and then emitting natural humidified air as circulation air.

The machine compartment 200 may be positioned in any direction with respect to the storage compartment 100, but preferably positioned under the storage compartment 100. This is because the condensate water condensed in the storage compartment 100 or saturated humid air can be flowed into the machine compartment 200 by its own weight, and thus can be discharged to the outside through the condensate water tank 280.

The machine compartment 200 includes the intake port 210, a first flow path 220, a blower unit 230, a second flow path 240, the exhaust port 250, a heating unit 260, the supply water tank 270, and the condensate water tank 280.

The intake port 210 is a part through which the outside air is drawn into the machine compartment 200. It may be selectively opened or closed. For example, it may be opened in the air cleaning mode and closed in the clothes care mode. The location of the intake port 210 is preferably under the exhaust port 250 to be described below, and more preferably is at a lowermost end of the machine compartment 200. Since the intake port 210 is closed in the clothes care mode, the circulation flow path of the circulation air can be made simpler, and it is also preferable that the door 600 not reach the intake port 210.

A clean filter unit detaching part 218 may be positioned in the intake port 210, on which a clean filter unit 219 may be positioned. The clean filter unit 219 in the air cleaning mode may serve to filter the incoming outside air, and may include a pre-filter, a HEPA filter, and the like, but is not limited thereto.

The first flow path 220 is in communication with the intake port 210, the second flow path 230, and the blower unit 230. The outside air drawn in by the intake port 210 and then filtered in the air cleaning mode, and the circulation air drawn in through the second flow path 230 in the clothes care mode are flowed into the first flow path 220.

The circulation filter unit 229 is positioned inside the first flow path 220. The circulation filter unit 229 may serve to filter the circulation air. The circulation filter unit 229 may include a humidification filter, such that, with the supply of water stored in the supply water tank 270 to the humidification filter, moisture is supplied to the circulation air passed therethrough, thereby forming natural humidified air. The user may open the door 600 and access the circulation filter detaching part 129 to detach or attach the circulation filter unit 229.

In another embodiment of the multi-functional storage system, heat is applied to the humidification filter provided in the circulation filter unit 229 or to a tubing connecting the supply water tank 270 and the humidification filter, so that natural humidified air may be heated to a certain temperature level and supplied to the storage compartment 100. A separate heating member (not shown) may be used to apply heat, or the heat generated during a process at the dehumidification unit 260 to be described below for performing dehumidification may be used.

An inlet side of the blower unit 230 is communicated with the first flow path 220 to provide power to intake air to the first flow path 220. The outside air is drawn into the first flow path 220 by the operation of the blower unit 230 in the air cleaning mode, and the air inside the storage compartment 100 is drawn into the first flow path 220 as the circulation air in the clothes care mode. A discharge side of the blower unit 230 is communicated with the second flow path 240. In addition, since the exhaust port 250 is positioned above the intake port 210 and the storage compartment 100 is positioned above the machine compartment 200, a second flow path communicable with the exhaust port 250 and the storage compartment 100 240 may be positioned above the blower unit 230 and the first flow path 220.

The second flow path 240 receives the filtered outside air or the circulation air from the blower unit 230. The second flow path 240 is selectively communicated with one of the storage compartment 100 and the exhaust port 250, and includes a first flow path switching member 241 and a second flow path switching member 242 for control purposes. The first flow path switching member 241 and the second flow path switching member 242 are paired and operated to change the flow path. In an embodiment, the first flow path switching member 241 and the second flow path switching member 242 may be members rotated about an axis, although any mechanism that can selectively change the flow path may be adopted.

Figure 8:
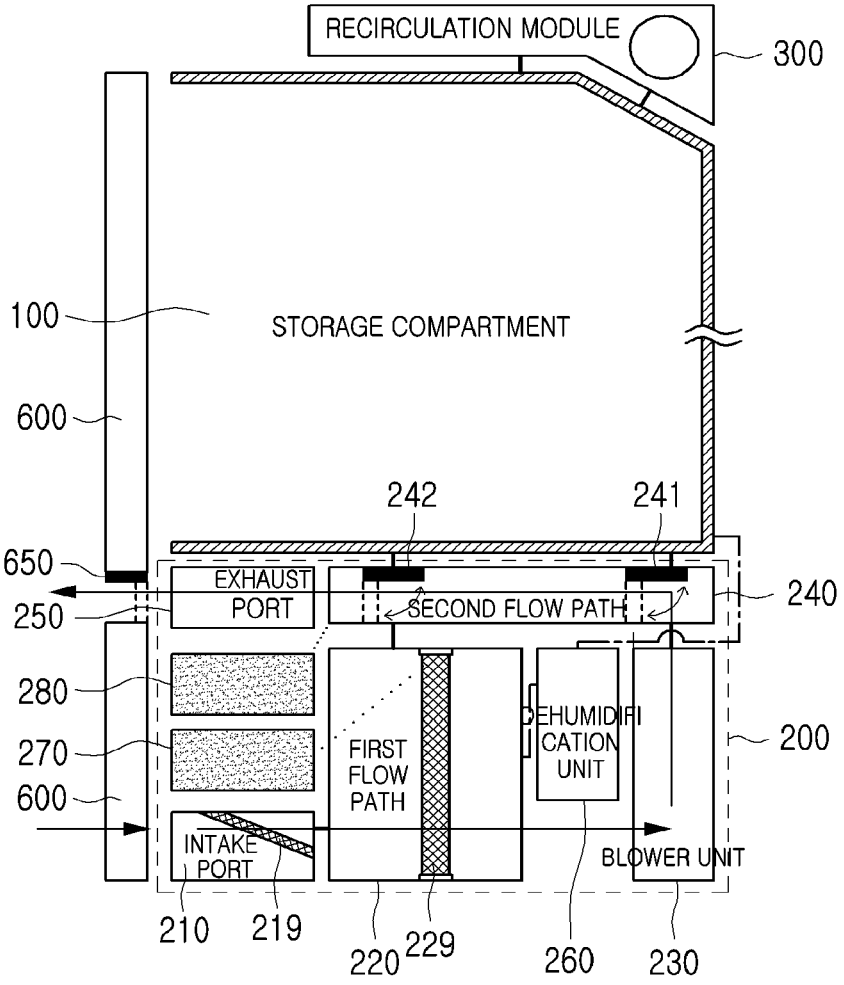
FIG. 8 is a conceptual diagram for explaining an air cleaning mode of the multi-functional storage system according to the present invention.
Figure 9:
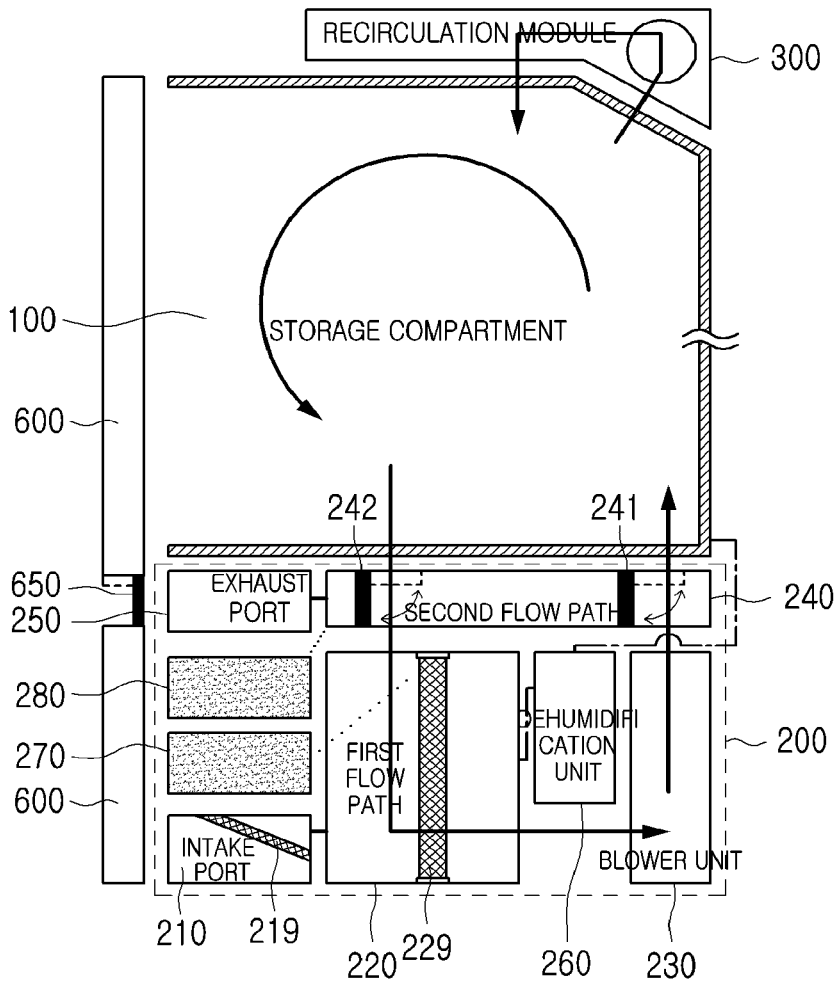
FIG. 9 is a conceptual diagram for explaining the clothes care mode of the multi-functional storage system according to the present invention.
Figure 10:
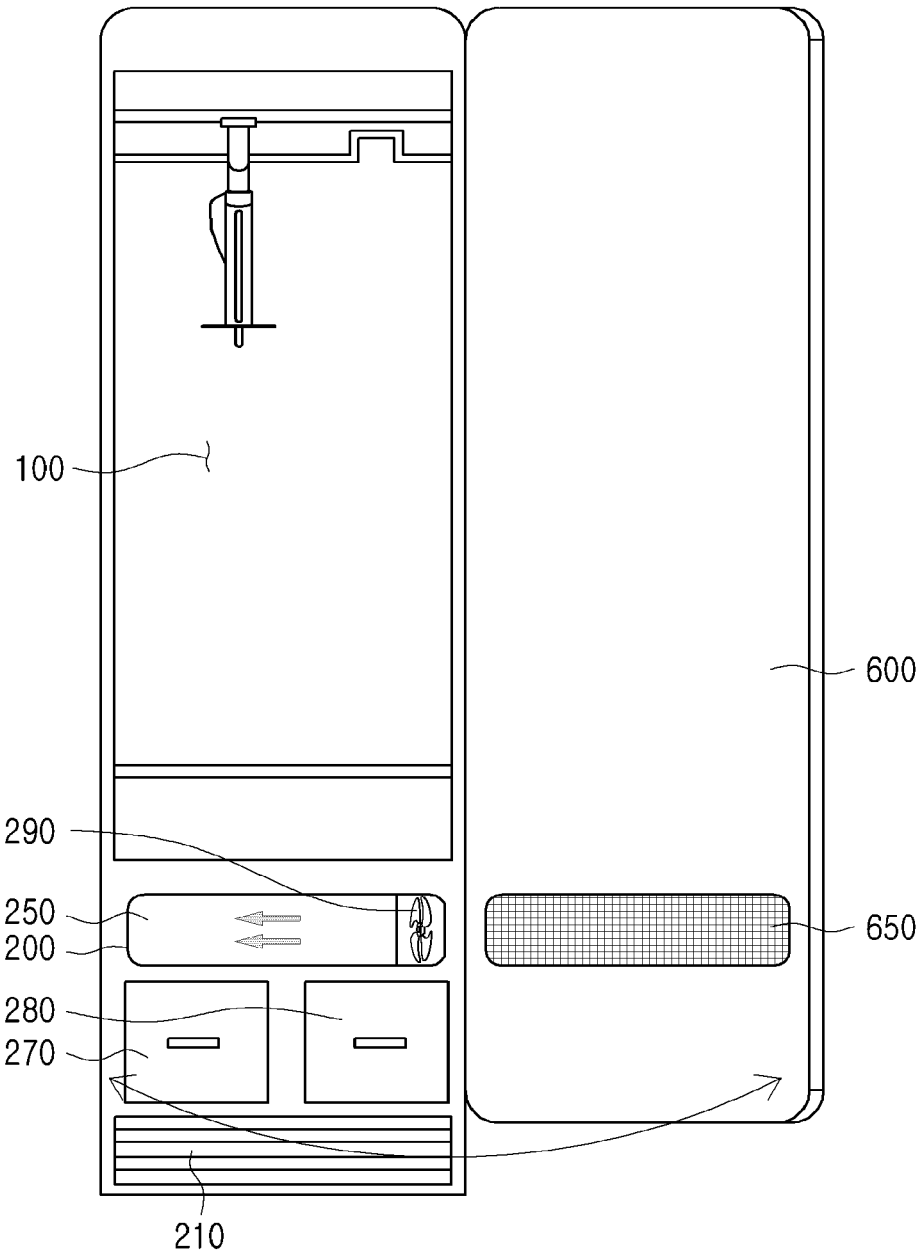
FIG. 10 is a front view showing a multi-functional storage system with the door open, in an embodiment in which a dehumidification blower is provided according to the present invention.
Figure 11:
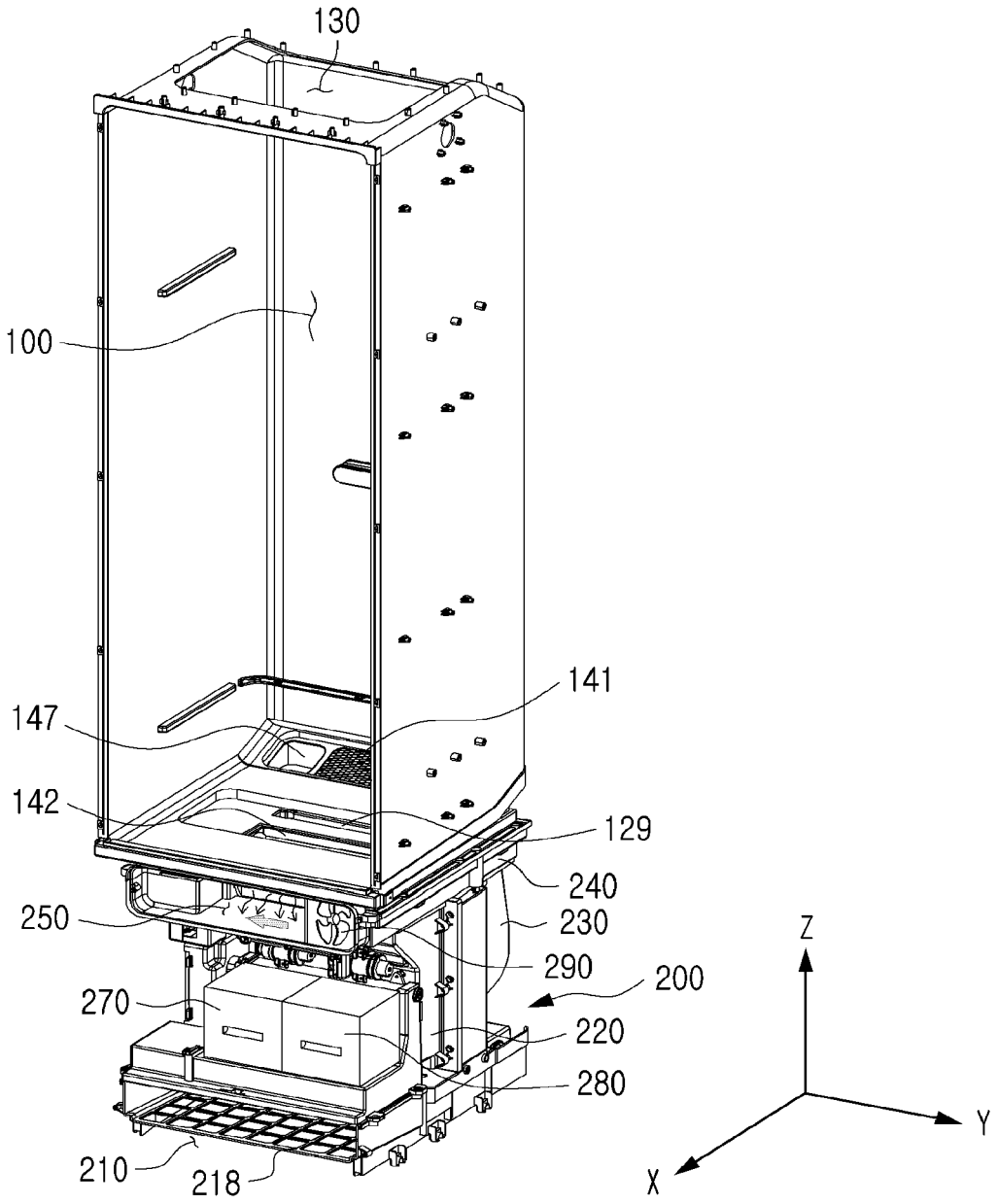
FIG. 11 is a perspective view showing the interior of the embodiment shown in FIG. 10, from which the illustrations of a casing, the door, and a recirculation module are removed for the sake of explanation.
Figure 12:
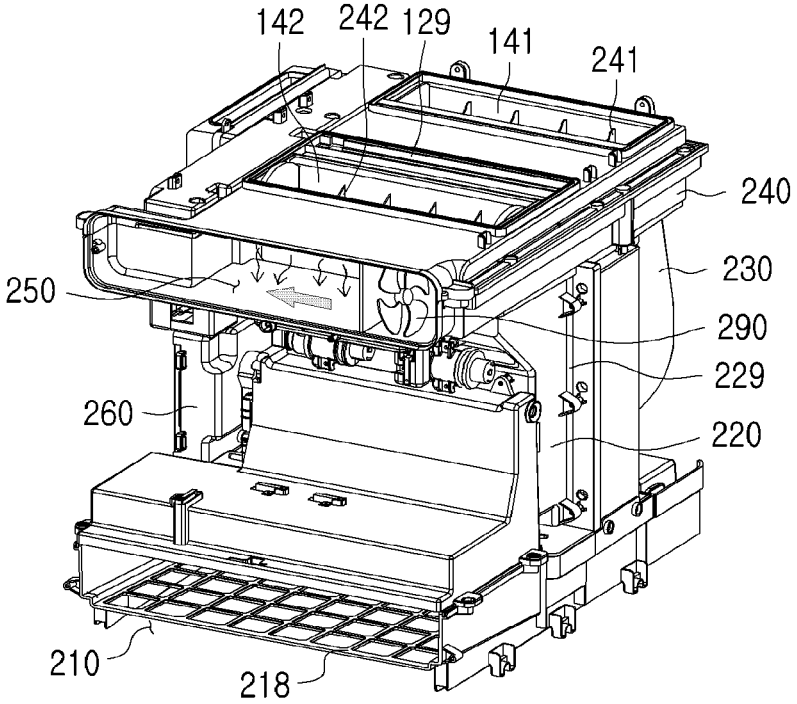
FIG. 12 is a perspective view showing a machine compartment of the embodiment shown in FIG. 10, showing a dehumidification blower provided in an exhaust port.
Figure 13:
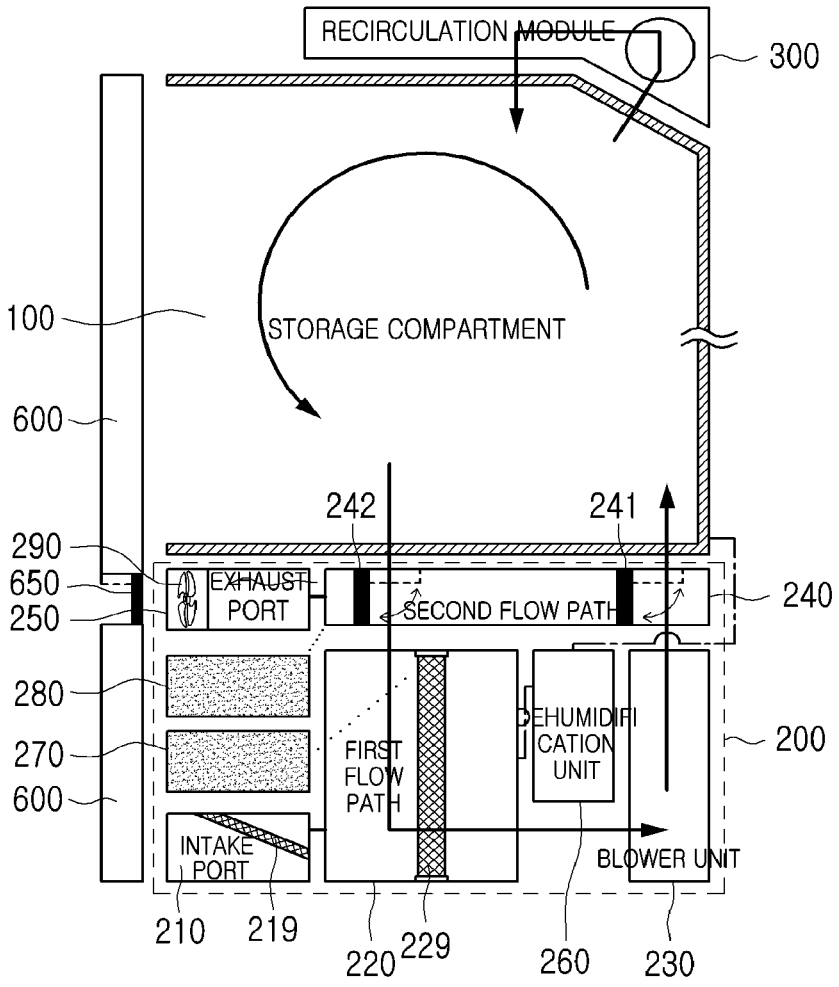
FIG. 13 is a conceptual diagram for explaining a clothes care mode in the embodiment shown in FIG. 10.
Figure 14:
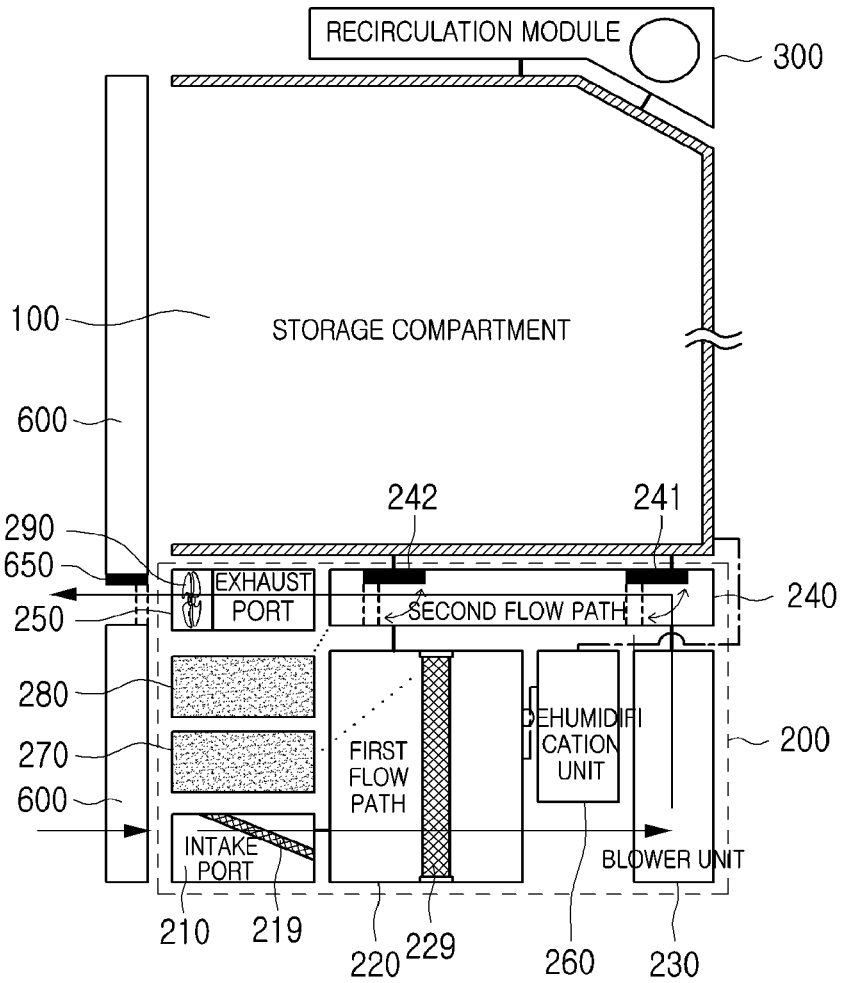
FIG. 14 is a conceptual diagram for explaining an air cleaning mode in the embodiment shown in FIG. 10.

The first flow path switching member 241 and the second flow path switching member 242 cause the second flow path 240 to be blocked from the storage compartment 100 and communicated with the exhaust port 250 in the air cleaning mode (see FIG. 8), and cause the second flow path 240 to be communicated with the storage compartment 100 and blocked from the exhaust port 250 in the clothes care mode (see FIG. 9). That is, the air circulates in the clothes care mode such that the circulation air of the second flow path 240 is flowed into the storage compartment 100 through the circulation air inlet 141 positioned above the first flow path switching member 241, and the circulation air inside the storage compartment 100 is flowed back to the second flow path 240 through the circulation air outlet 142 positioned above the second flow path switching member 242. Details are described below with reference to the operation mode.

The exhaust port 250 receives the filtered outside air from the second flow path 240 and discharges it to the outside. The exhaust door 650 may be positioned outside the door 600 that corresponds to the exhaust port 250 and open and close the exhaust port 250. For example, the exhaust door 650 may be opened such that the filtered outside air is discharged from the exhaust port 250 in the air cleaning mode, and the exhaust door 650 may be closed in the clothes care mode.

The dehumidification unit 260 performs a function of dehumidifying the circulation air flowing through the storage compartment 100. It is necessary to perform dehumidification to keep the inside of the storage compartment 100 and circulation air comfortable and also to prevent re-contamination. The circulation air in the storage compartment 100 may be dehumidified, or the circulation air flowing from the storage compartment 100 to the machine compartment 200 may be dehumidified. For example, the dehumidification unit 260 may be a heat pump, but is not limited thereto. Heat may be generated while the dehumidification unit 260 performs dehumidification, but this heat may be used in the clothes care mode (indicated by dashed-dotted lines in FIGS. 6 to 9) rather than being discarded. For example, the heat generated during the dehumidification process by the dehumidification unit 260 may be used to heat the storage compartment 100 to about 50 to 70 degrees Celsius, and then the circulation air at room temperature may be introduced from the second flow path 240 through the circulation air inlet 141 so that contaminants or odorous substances may be removed from the clothes or the like. For another example, as described above, the heat generated in the dehumidifying process by the dehumidification unit 260 may be supplied to the humidification unit of the circulation filter unit 229 or provided to the tubing connecting the supply water tank 270 and the humidification unit, thereby heating natural humidified air that serves as the circulation air. It goes without saying that the temperature described above is an example, and is not limited thereto, and may be variously changed. In addition, only one of the dehumidification unit 260 and the circulation filter unit 229 (that is, the humidification filter) may be selectively operated so as not to interfere with each other.

In another embodiment of the multi-functional storage system, the heat generated in the dehumidification process of the blower unit 230 and the dehumidification unit 260 in the clothes care mode may be used, or the warm air may be generated by a separate heating member (not shown) and discharged to the storage compartment 100. The circulation air may be turned into natural humidified air by the moisture supplied by the circulation filter unit 229 to be described below, and may be combined with the warm air supplied by the blower unit 230 to remove odor and contaminants from the stored clothes or the like. To this end, the dehumidification unit 260 or the separate heating member (not shown) may be positioned adjacent to the circulation air inlet 141. In addition, since both the amount of natural humidified air and the amount of warm air can be controlled by the user, an optimized control method that suits the type and material of clothes or the like to be stored may be provided in a separate mode.

In addition, in another embodiment of the multi-functional storage system, an entire circulation mode in which the machine compartment 200 communicates with both the outside air and the storage compartment 100, and an entire blocking mode in which the machine compartment 200 is blocked from both the outside air and the storage compartment 100 may be further provided, and these will be described below.

The supply water tank 270 stores water to be supplied to the humidification filter provided in the circulation filter unit 229. To this end, it is connected to the circulation filter unit 229 through tubing. The condensate water tank 280 may collect and store the condensate water generated in the storage compartment 100, or collect and store the condensate water generated in the process in which saturated humid air generated in the storage compartment 100 is flowed into the first flow path 220 or the second flow path 240 of the machine compartment 200 and the like and condensed therein. To this end, it is connected to the storage compartment 100 and/or the first flow path 220 and/or the second flow path 220 through tubing.

In order to fill the water or discard the filled condensate water, it is preferable that both the user's supply water tank 270 and the condensate water tank 280 be easily accessible. To this end, the supply water tank 270 and the condensate water tank 280 are preferably positioned on the foreside of the machine compartment 200, and the user is able to open the door 600 and easily remove them with a handle that is positioned in each of the tanks positioned under the exhaust port 250.

The recirculation module 300 serves to assist in recirculating the circulation air in the storage compartment 100 in the air cleaning mode, and also assist in direct drying of the clothes or the like. In addition, the recirculation module may be operated independently of whether or not the machine compartment 200 is operated, and may be operated to scatter dust out from the clothes or the like stored in the storage compartment 100.

Figure 5:
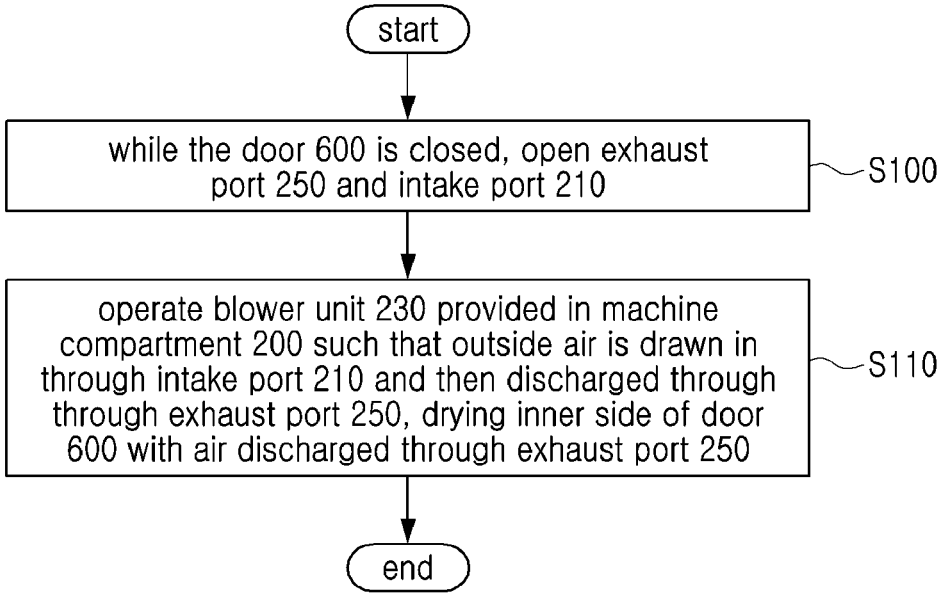
FIG. 5 is a flow chart of a drying method for preventing water from condensing on an inner side of the door of the multi-functional storage system according to the present invention.

Description of Drying Method for Preventing Water from Condensing on the Inner Side of the Door of the Multi-Functional Storage System FIG. 5 is a flow chart of a drying method for preventing water from condensing on the inner side of the door of the multi-functional storage system according to the present invention.

Referring to FIG. 5, the method of drying the inner side of the door of the multi-functional storage system according to the present invention includes steps of with the door 600 closed, opening the intake port 210 and the exhaust port 250 (S100), and operating the blower unit 230 provided in the machine compartment 200 such that outside air is drawn in through the intake port 210 and then discharged through the exhaust port 250, drying the inner side of the door 600 with the air discharged through the exhaust port 250 (S110). The prerequisite for this is that the machine compartment 200 is provided with the intake port 210 and the exhaust port 250 communicating with outside air, and that the exhaust port 250 is formed in such a structure that it faces the inner surface of the door 600 while the door 600 is closed.

Accordingly, as the blower unit 230 provided in the machine compartment 200 is operated, the outside air, which is dry air, is drawn in through the intake port 210, and then discharged through the exhaust port 250 to supply dry air to the inner side of the door 600. This is to dry the water droplets formed in a predetermined space between the door 600 and the foreside of the machine compartment 200 while the door 600 is closed.

Without the drying operation, water droplets may be formed on the inner side of the door 600 by the circulation air, which is high-temperature and high-humidity air, and this may cause a problem of water droplets falling onto the floor surface of the space where the multi-functional storage system is positioned.

Meanwhile, it is preferable that the drying method for preventing water from condensing on the inner side of the door of the multi-functional storage system according to the present invention be performed for about 6 minutes in the clothes care mode (basic mode) that takes a total of 45 minutes, and performed for about 11 minutes in the clothes care mode (pro mode) that takes a total of 95 minutes, although it may be set differently as selected by the designer.

The step (S100) may further include a step of closing the exhaust door 650 when the exhaust door 650 is open (S102). This is in consideration of the following. That is, in the air cleaning mode, the exhaust door 650 is opened, and if the drying method according to the present invention is performed without checking whether or not the exhaust door 650 is opened, all of the air to be discharged through the exhaust port 250 by the blower unit 230 may be discharged through the exhaust door 650, and in that case, it may not be possible to dry the inner side of the door 600. Accordingly, in order to maximize the drying efficiency on the inner side of the door 600, it is necessary to check whether or not the exhaust door 650 is opened, and close the exhaust door 650 when the exhaust door 650 is opened.

In addition, the step (S100) may further include a step of blocking communication between the storage compartment 100 and the machine compartment 200 (S104). This is in consideration of the following. That is, when the blower unit 230 is operated while the storage compartment 100 and the machine compartment 200 are not in communication, the air discharged by the blower unit 230 may be circulated to the storage compartment 100 rather than being concentrated toward the exhaust port 250, and in that case, drying efficiency on the inner side of the door 600 may be reduced.

In addition, the recirculation module 300 including the recirculation blower may be provided on an upper end of the storage compartment 100 of the multi-functional drying system according to the present invention, in which the recirculation module 300 may be formed to discharge air downward in the storage compartment 100, and in the step (S110), the recirculation blower may be operated at the same time as the blower unit 230 is operated. At this time, it is preferable that communication between the storage compartment 100 and the machine compartment 200 be blocked, and in this state, the recirculation blower may be operated, so that the storage compartment 100 may be dried and the inner upper part of the door 600 may be dried.

In addition, the multi-functional drying system according to the present invention may further include a humidity sensor (not shown). Accordingly, the humidity sensor may be used to sense the humidity of the space where the multi-functional drying system is positioned, and when the humidity of the space is relatively too high, the drying method for preventing water from condensing on the inner side of the door of the multi-functional storage system according to the present invention may be forcibly deferred.

Description of Operation Modes of Multi-Functional Storage System

The operation modes of the multi-functional storage system according to the present invention will be described with reference to FIGS. 6 to 9.

Figure 6:
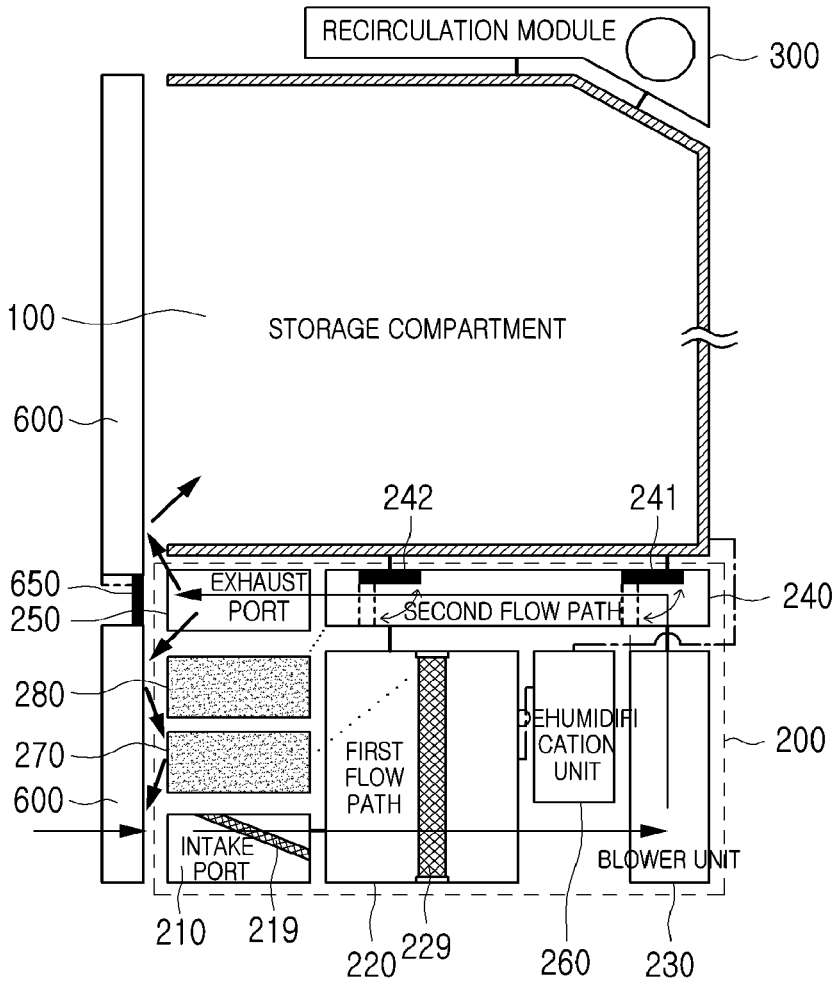
FIG. 6 is a conceptual diagram for explaining a drying method for preventing water from condensing on the inner side of the door of the multi-functional storage system according to an embodiment of the present invention.
Figure 7:
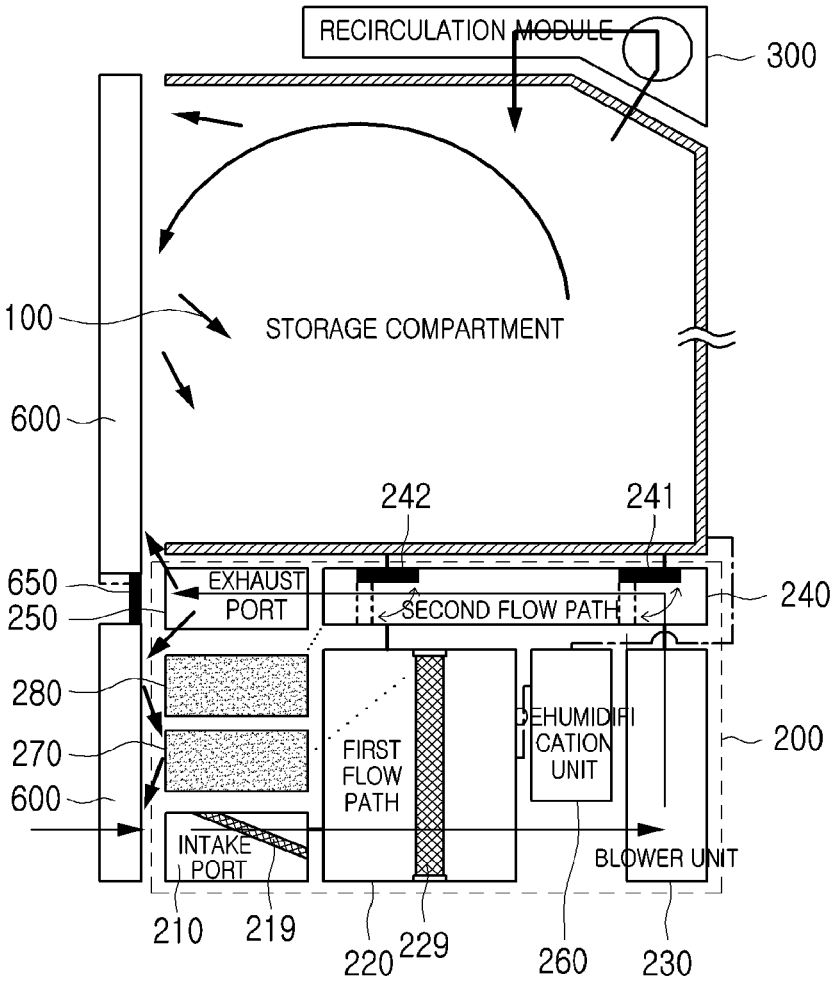
FIG. 7 is a conceptual diagram for explaining a drying method for preventing water from condensing on the inner side of the door of the multi-functional storage system according to another embodiment of the present invention.

First, the "door drying mode" will be described. Reference is made to FIGS. 6 and 7.

As described above, the door drying mode is a mode for removing water droplets formed on the inner side of the door 600 or in the space between inner side of the door 600 and the front surface of the machine compartment 200. In order to perform the door drying mode, while the door 600 is closed, it is necessary to close the exhaust door 650 as well. In addition, for this purpose, dry air is required, and accordingly, it is necessary to open the intake port 210 to draw outside air, which is dry air. This may be regarded as performing the air cleaning mode to be described below with the exhaust door 650 being closed. However, the air cleaning mode to be described below differs in that the opening of the exhaust door 650 is essential.

Referring to FIG. 6, the outside air, which is dry air introduced through the intake port 210, is flowed through the first flow path 220 and to the blower unit 230, and flowed through the second flow path 240 and then discharged through the exhaust port 250. At this time, since the exhaust door 650 is closed, the air discharged through the exhaust port 250 is not immediately exhausted to the outside, but may be flowed while being reflected in the space between the door 600 and the machine compartment 200. Of course, the outside air introduced through the intake port 210 is introduced by the operation of the blower unit 230, but even when the blower unit 230 is not operated, it may still be naturally introduced while the intake port 210 is open.

In addition, the first flow path switching member 241 and the second flow path switching member 242 are formed to selectively communicate the second flow path 240 with the exhaust port 250 or the storage compartment 100. In the door drying mode of the multi-functional storage system according to the present invention, the blower unit 230 may be operated while the second flow path 240 is in communication with the exhaust port 250 by the first and second flow path switching members 241 and 242, thereby drying the inner side of the door 600.

In addition, it is preferable that the door drying mode of the multi-functional storage system according to the present invention be automatically started after the clothes care mode is ended, and operated for a predetermined time.

FIG. 7 shows the recirculation blower of the recirculation module 300 of the storage compartment 100 being simultaneously operated as the blower unit 230 of the machine compartment 200 is operated. As described above, with the exhaust door 650 being closed, the blower unit 230 and the recirculation blower of the recirculation module 300 may be operated at the same time, thereby increasing drying efficiency on the inner side of the door 600.

Next, the "air cleaning mode" will be described. Reference is made to FIG. 8.

The air cleaning mode is a mode in which only the machine compartment 200 is operated independently from the storage compartment 100 to perform a function of purifying the outside air. That is, it is an operation mode in which, when the outside air is contaminated, the outside air is prevented from being flowed into the storage compartment 100 because there may be clean clothes or the like positioned inside the storage compartment 100.

When the user selects the air cleaning mode, the exhaust door 650 of the door 600 is opened and the intake port 210 is also opened.

The first flow path switching member 241 and the second flow path switching member 242 of the machine compartment 200 are operated so that the second flow path 240 is communicated with the exhaust port 250 and blocked from the storage compartment 100 and the first flow path 220. In this process, the storage compartment 100 becomes a space independent from the machine compartment 200.

The blower unit 230 is operated. With the operation of the blower unit 230, the outside air is flowed into the first flow path 220 through the intake port 210 and is directed toward the blower unit 230. In the process of passing through the intake port 210, the outside air is filtered by the clean filter unit 219 positioned in the intake port 210. In the process of passing through the first flow path 220, the air may be further filtered by the circulation filter unit 229 positioned in the first flow path 220. At this time, the humidification filter positioned in the circulation filter unit 229 may or may not perform the humidification function according to the user's selection. When humidifying the outside air, the supply water reservoir 270 supplies water to the humidification filter, which is similar to the clothes care mode. The filtered outside air passed through the blower unit 230 is then passed through the second flow path 240 and exhausted to the outside through the exhaust port 250.

As this process is repeated, the multi-functional storage system according to the present invention functions as a kind of air purifier. The outside air is continuously flowed into the machine compartment 200 and filtered, and the filtered air is continuously exhausted.

This is desirable, because the air cleaning mode can be performed regardless of whether or not the user opens the door 600. While the air cleaning mode is in operation, the user can still freely open the door 600 to place clothes or the like inside the storage compartment 100 or take out clothes or the like. At any time, water may be filled in the supply water tank 270 and the water in the condensate water tank 280 may be discharged. Since the door 600 does not cover the intake port 210 and the exhaust port 250 is open from the inner side of the door 600, opening the door 600 does not affect the operation of the air cleaning mode.

Even when the user is at a remote distance from the multi-functional storage system, that is, at a location where the user is not easily able to see the control unit 610, by checking only whether or not the exhaust door 650 is open, the user is able to know whether the operation is in the air cleaning mode or the clothes care mode.

As the operation continues in the air cleaning mode or the clothes care mode, the filter may be contaminated, in which case the user can easily replace the filter. In the case of the clean filter unit 219, the user can reach his or her hand to the intake port 210 below the door 600 and replaced the filter. In the case of the circulation filter unit 229, the user can open the door 600 and replace the filter by using the circulation filter detaching part 129.

The "clothes care mode" will be described. Reference is made to FIG. 9.

The clothes care mode is a mode in which contaminants or malodorous substances are removed from clothes or the like positioned inside the storage compartment 100. The inside of the storage compartment 100 may be kept in a humid environment by circulating the natural humidified air as the circulation air, and the contaminants or malodorous substances of the clothes or the like are removed together with the humid air and flowed into the machine compartment 200 and discharged as condensate water. In this process, the dehumidification unit 260 performs dehumidification of the circulation air flowing in the storage compartment 100. Optionally, the interior of the storage compartment 100 may be heated using the heat generated from the dehumidification unit 260. That is, in the clothes care mode, the circulation filter unit 229 and the dehumidification unit 260 may each be operated alternately for a predetermined time, so that humidification and dehumidification of the storage compartment 100 may be alternately performed.

When the user selects the clothes care mode, the exhaust door 650 of the door 600 is closed and the intake port 210 is also closed. That is, in the clothes care mode, the air in the storage compartment 100 is not substantially exhausted to the outside.

The dehumidification unit 260 dehumidifies the circulation air flowing in the storage compartment 100. Optionally, the heat generated in this process may heat the interior of the storage compartment 100, and the temperature may be 50 to 70 degrees Celsius, but is not limited thereto. The first flow path switching member 241 and the second flow path switching member 242 of the machine compartment 200 are operated so that the second flow path 240 is communicated with the storage compartment 100 and the first flow path 220, and blocked from the exhaust port 250. Water from the supply water tank 270 is supplied to the humidification filter provided in the circulation filter unit 229 so that the humidification filter can retain moisture. In this process, the humidification filter or the water supplied to the humidification filter may be heated by the heat generated from the dehumidification unit 260 or from a separate heating member (not shown).

Simultaneously with dehumidification or after dehumidification, the blower unit 230 is operated. With the operation of the blower unit 230, the air inside the storage compartment 100 is flowed into the second flow path 240 through the circulation air outlet 142, and is flowed back into the first flow path 220 and directed toward the blower unit 230. In this process, the air is passed through the humidification filter of the circulation filter unit 229 to become natural humidified air. The air is again passed through the second flow path 240 to be supplied to the storage compartment 100 through the circulation air inlet 141.

As this process is repeated, the circulation air is continuously circulated between the storage compartment 100 and the machine compartment 200. The contaminants or malodorous substances may be entrained in the circulation air in the storage compartment 100, but since they are not discharged to the outside, a comfortable environment is provided to the user. In addition, once the circulation air including contaminants or malodorous substances is flowed into the machine compartment 200, it is filtered by the circulation filter unit 229, condensed into condensate water, and collected separately in the condensate water tank 280, so that the re-contamination phenomenon in which the contaminants or malodorous substances are supplied back to the storage compartment 100 is prevented, which is desirable.

Meanwhile, in the clothes care mode, warm air may be generated by the blower unit 230 and the dehumidification unit 260 or a separate heating member (not shown) and discharged into the storage compartment 100, and in this case, the natural humidified air may be first discharged to the storage compartment 100, and then the warm air may be discharged to the storage compartment 100 after the discharge of the natural humidified air is stopped.

The recirculation module 300 assists in the circulation of the circulation air. The recirculation module 300 recirculates the circulation air in the upper side of the storage compartment 100, ensuring that the convection phenomenon is more efficiently performed throughout the storage compartment 100.

In another embodiment of the present invention, only the recirculation module 300 may be operated while the other the devices in the machine compartment 200 may not be operated, so that only a duster function may be implemented for the clothes or the like mounted in the storage compartment 100.

Along with the description of the clothes care mode described above, an embodiment in which a dehumidification blower is provided in the multi-functional storage system according to the present invention will be described in detail by referring to FIGS. 10 to 14 again. The embodiment relates to a structure including a dehumidification blower for preventing water from condensing on the inner side of the door, and specifically, a dehumidification blower 290 is provided in the exhaust port 250.

During the clothes care mode, the circulation filter unit 229 and the dehumidification unit 260 may be selectively operated, and the circulation filter unit 229 and the dehumidification unit 260 may be alternately operated according to a preset time, so that humidification and dehumidification of the storage compartment 100 may be repeatedly performed. In this process, high-temperature and high-humidity air is circulated in the storage compartment 100, and this circulation air circulates through the storage compartment 100 and the machine compartment 200 through the open circulation air inlet 141 and circulation air outlet 142.

In order to prevent the high-temperature and high-humidity circulation air from being lost to the outside while circulating between the storage compartment 100 and the machine compartment 200, the second flow path switching member 242 for selectively communicating the exhaust port 250 or the storage compartment 100 may be operated at a position such that the second flow path 240 is communicated with the storage compartment 100 and blocked from the exhaust port 250. It is to be noted that the circulation air may leak out through the gaps of the respective members even in the state where the exhaust port 250 is blocked, in which case part of the high-temperature and high-humidity air may leak out through the exhaust port 250 contrary to the intention of the designer. At this time, since the exhaust door 650 is closed, the high-temperature and high-humidity circulation air leaking through the exhaust port 250 stays in the gap or space between the machine compartment 200 and the door 600, resulting in the phenomenon in which water droplets form between the machine compartment 200 and the inner side of the door 600.

The present embodiment includes the dehumidification blower 290 for drying the high-temperature and high-humidity air leaking out through the exhaust port 250 during the clothes care mode in order to prevent such condensation of water droplets. The exhaust port 250 is formed to extend by a predetermined length toward the front side of the multi-functional storage system, and the dehumidification blower 290 is preferably provided at one side of the exhaust port 250.

At this time, the dehumidification blower 290 is provided at the side end of the exhaust port 250 based on the direction of the air discharged from the exhaust port 250, and is formed to blow the air in a direction perpendicular to the direction of the air discharged from the exhaust port 250. In this way, by forming an air curtain in the exhaust port 250 by way of the dehumidification blower 290, the phenomenon of circulation air leaking through the exhaust port 250 can be limited, and even if a small amount of circulation air leaks out, since this can be dried with the dehumidification blower 290, the phenomenon in which high-temperature and high-humidity air stays at the inner side of the door 600 can be prevented.

Meanwhile, the dehumidification blower 290 may be configured to blow air in a direction perpendicular to the direction of air discharged from the exhaust port 250, but may be configured to blow in an acute angle direction as selected by the designer.

In addition, while FIGS. 10 to 14 show that only one dehumidification blower 290 is provided at one end of the exhaust port 250, the dehumidification blower 290 may be provided as a pair, and these may be configured to blow air in a direction of facing each other.

The dehumidification blower 290 may be formed to automatically start operating as the clothes care mode is started, and automatically stop operating as the clothes care mode is ended. This is because, in the following description on the air cleaning mode of the multi-functional storage system to be described below, the air purified by the clean filter unit 219 is forced to be discharged through the exhaust port 250 in the air cleaning mode, and accordingly, it is unnecessary to form the air curtain toward the air discharged through the exhaust port 250.

That is, since the dehumidification blower 290 is provided to prevent the high-temperature and high-humidity air from leaking out through the exhaust port 250 while the high-temperature and high-humidity air is circulating in the storage compartment 100 and the machine compartment 200 in the clothes care mode, the dehumidification blower 290 starts operating when the exhaust port 250 is closed, and the dehumidification blower 290 stops operating when the exhaust port 250 is open.

Here, the size, shape, and position of the dehumidification blower 290 can be changed as selected by the designer, and the dehumidification blower 290 is preferably formed so as not to affect the humidity and temperature of the air flowing through the second flow path 240 while the exhaust port 250 is closed.

Meanwhile, in another embodiment of the multi-functional storage system according to the present invention, the "entire circulation mode" and the "entire blocking mode" are further included in addition to the clothes care mode and the air cleaning mode described above.

The "entire circulation mode" is a mode in which the clean filter unit 219 provided in the machine compartment 200 is communicated with both the storage compartment 100 and the outside air of the multi-functional storage system. In the clean filter unit 219, the air inside the storage compartment 100 is introduced and filtered, and the outside air of the multi-functional storage system is also introduced and filtered. This circulation mode is advantageous when the quality of indoor air (that is, outside air) and air inside the storage compartment 100 is not too poor so that the air can be rapidly circulated and purified.

The "entire blocking mode" is a mode in which the machine compartment 200 is not communicated with the storage compartment 100 and the outside air of the multi-functional storage system, as opposed to the entire circulation mode. For example, the mode is advantageous when the performance of the clean filter unit 219 is degraded and it needs to be replaced, or when filtration of air inside the storage compartment 100 or indoor air is not particularly required, and when only preheating of the machine compartment 200 is required.

While the present invention has been described above with reference to the embodiments shown in the drawings to help those skilled in the art easily understand and reproduce the present invention, it will be appreciated that this is merely exemplary, and those skilled in the art will understand that various modifications and other equivalent embodiments are possible from the embodiments of the present invention. Therefore, the scope of protection of the present invention should be determined by the claims.

DESCRIPTION OF REFERENCE NUMERALS

100: storage compartment
129: circulation filter detachment part
130: recirculation module mounting part
141: circulation air inlet
142: circulation air outlet
147: functional material receiving part
200: machine compartment
210: intake port

218: clean filter unit detachment part
219: clean filter unit
220: first flow path
229: circulation filter unit
230: blower unit
240: second flow path
241: first flow path switching member
242: second flow path switching member
250: exhaust port
260: dehumidification unit
270: supply water tank
280: condensation water tank
300: recirculation module
500: casing
600: door
610: control unit
650: exhaust door

The invention claimed is:

1. A multi-functional storage system, comprising:
a storage compartment;
a machine compartment provided at one side of the storage compartment;
a circulation air inlet and a circulation air outlet communicating the storage compartment with the machine compartment; and
a door provided at a foreside of the storage compartment and the machine compartment,
wherein the machine compartment comprises:
an intake port and an exhaust port communicating with outside air; and
a blower unit for drawing in the outside air through the intake port and exhausting it through the exhaust port, or drawing in the inside air through the circulation air inlet and exhausting it through the circulation air outlet,
wherein, while the door is closed and, the intake port and the exhaust port are open, and the circulation air inlet and the circulation air outlet are closed, the blower unit is operated to dry an inner side of the door.

2. The multi-functional storage system according to claim 1, further comprising:
a recirculation module including a recirculation blower provided at an upper end of the storage compartment,
wherein the recirculation module discharges air downward in the storage compartment,
wherein, in a storage compartment drying mode of drying the storage compartment, the recirculation blower is operated while the circulation air inlet and the circulation air outlet are closed, and
wherein a door drying mode of drying an inner side of the door and the storage compartment drying mode are operated simultaneously.

3. The multi-functional storage system according to claim 2,
wherein the machine compartment further comprises a clean filter unit for filtering the outside air drawn in from the intake port,
wherein the door comprises an exhaust door formed on one side, and is formed to cover the foreside of the machine compartment and the storage compartment except for the intake port,
wherein, in an air cleaning mode of filtering the outside air, the circulation air inlet and the circulation air outlet are closed, and the intake port, the exhaust port, and the exhaust door are open, and
wherein, in the door drying mode and the storage compartment drying mode, the exhaust door is closed.

4. The multi-functional storage system according to claim 3, wherein the exhaust door is formed at a position to face the exhaust port of the machine compartment when the door is closed.

5. The multi-functional storage system according to claim 1, further comprising:
a dehumidification unit that dehumidifies circulation air flowing in the storage compartment;
a circulation air inlet and a circulation air outlet that communicate the storage compartment with the machine compartment;
a circulation filter unit that supplies moisture to the circulation air supplied to the storage compartment through the circulation air inlet; and
a dehumidification blower provided on a side of the exhaust port,
wherein the dehumidification blower dries circulation air exiting through the exhaust port.

6. The multi-functional storage system according to claim 5, wherein the dehumidification blower is provided at an end side of the exhaust port based on a direction of the air discharged from the exhaust port.

7. The multi-functional storage system according to claim 6, wherein the dehumidification blower is provided at both end sides of the exhaust port, and formed to blow in a direction of both end sides facing each other.

8. The multi-functional storage system according to claim 4, wherein the dehumidification blower is provided on a side end inside the exhaust port, and formed to blow in a direction perpendicular to the direction of the air discharged from the exhaust port.

9. The multi-functional storage system according to claim 4, wherein, while the circulation air inlet and the circulation air outlet are open and the exhaust port is closed, the dehumidification blower is operated as natural humidified air generated by the circulation filter unit is supplied to and circulated in the storage compartment by the blower unit.

10. The multi-functional storage system according to claim 9, wherein the machine compartment further comprises:
a first flow path in communication with the blower unit;
a second flow path in communication with each of the exhaust port, the blower unit, the first flow path, and the storage compartment;
a first flow path switching member that opens and closes the circulation air inlet; and
a second flow path switching member that opens and closes the circulation air outlet,
wherein the first and second flow path switching members selectively communicate the second flow path with the exhaust port or with the storage compartment, and
wherein the dehumidification blower is operated while the second flow path and the storage compartment are in communication with each other.

11. A method of drying an inner side of a door using the multi-functional storage system according to claim 1, the method comprising:
opening, while the door is closed, both the exhaust port and the intake port facing the inner surface of the door; and
operating the blower unit provided in the machine compartment such that the outside air is drawn in through the intake port and then discharged through the exhaust port, and drying the inner side of the door with the air discharged through the exhaust port.

12. The method according to claim 11, wherein the door comprises an exhaust door formed on one side, and is formed to cover the foreside of the machine compartment and the storage compartment except for the intake port, and wherein the opening further comprises closing the exhaust door when the exhaust door is open.

13. The method according to claim 11, the opening further comprises blocking communication between the storage compartment and the machine compartment.

14. The method of claim 13, further comprising:

discharging, via a recirculation module including a recirculation blower provided at an upper end of the storage compartment, air downward in the storage compartment, and the operating the blower unit includes simultaneously operating the recirculation blower and the blower unit.

* * * * *